United States Patent [19]

Wittek

[11] Patent Number: 4,852,261

[45] Date of Patent: Aug. 1, 1989

[54] KNIFE INSERT

[75] Inventor: Winfried D. Wittek, Walluf, Fed. Rep. of Germany

[73] Assignee: Chicago Pneumatic Tool Company, Fed. Rep. of Germany

[21] Appl. No.: 165,522

[22] Filed: Mar. 8, 1988

[51] Int. Cl.[4] ..... B26B 9/00; B26B 3/08; B26B 7/00; B26B 3/00

[52] U.S. Cl. ..... 30/347; 30/169; 30/272 A; 30/309

[58] Field of Search ..... 30/167, 169, 272 A, 30/272 R, 276, 309, 329, 335, 337, 342, 343, 344, 346.55, 346.57, 169, 272, 347; 56/12.7

[56] References Cited

U.S. PATENT DOCUMENTS

| | | | |
|---|---|---|---|
| 1,283,847 | 11/1918 | Markley | 30/272 A |
| 1,342,392 | 6/1920 | Oleen | 30/309 |
| 2,350,157 | 5/1944 | Disse | 30/169 |
| 3,052,981 | 9/1962 | Landes | 30/272 A |
| 3,152,399 | 10/1964 | Knab | 30/272 A |
| 3,308,535 | 3/1967 | Freeman et al. | 30/272 A |
| 3,740,847 | 6/1973 | Kliever et al. | 30/272 A |
| 3,811,160 | 5/1974 | MacDonald | 30/169 |
| 3,832,776 | 8/1974 | Sawyer | 30/272 A |
| 4,690,724 | 9/1987 | Outlaw | 30/169 |

*Primary Examiner*—Paul A. Bell
*Assistant Examiner*—Paul M. Heyrana, Sr.
*Attorney, Agent, or Firm*—Paul & Paul

[57] ABSTRACT

The invention relates to a knife insert for tools with an oscillating head, preferably of the type used for cutting open rubber or adhesive beading strips around windscreens and having a cutting face bounded by one or a plurality of cutting edges. When producing such a knife, in order to be able to use less expensive material and in order to be able considerably to reduce the reciprocating movements of the shank when driven by a tool which performs oscillatory rotary movements, it is according to the invention proposed that the knife be angled over in an L-shape at right-angles to its cutting face, the cutting face forming a first leg of the L, and the second leg of the L which extends substantially at a right-angle from the cutting face comprising a connecting element for connection to an actuating tool.

10 Claims, 3 Drawing Sheets

Fig.1
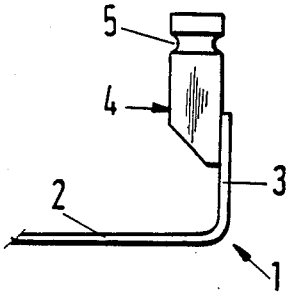
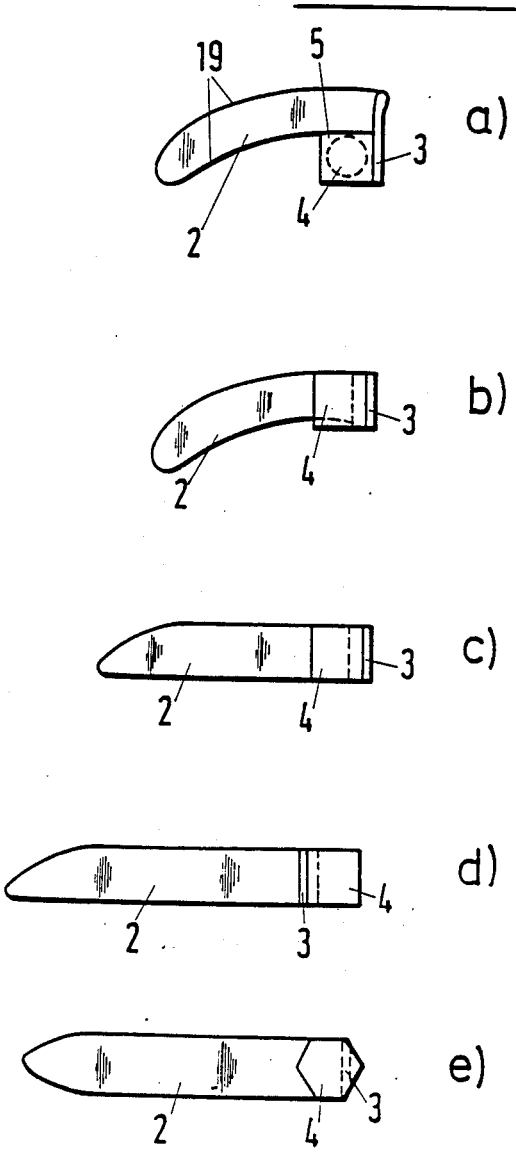
Fig.2
Fig.5
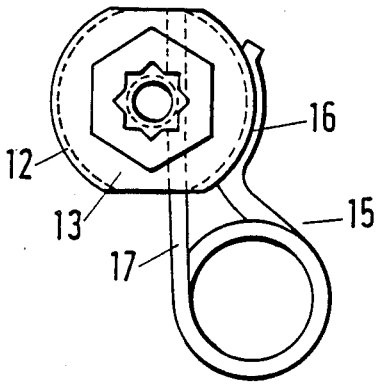

KNIFE INSERT

FIELD OF THE INVENTION

The invention relates to a knife insert for tools with an oscillating head, e.g. of the type used for cutting open rubber or adhesive beading strips around automobile windscreens.

BACKGROUND AND PRIOR ART

Such knives used for cutting open the rubber or adhesive beading around automobile windscreens generally comprise a flat or possibly slightly convex cutting face and in operation are mounted on an oscillating head which performs very rapidly oscillating rotary movements over a small angular range. For this purpose the knife is mounted on a spindle which serves as a tool carrier and which is in turn mounted on the head of a tool or driving assembly in such a way that it is rotatable through the aforementioned small angular range.

The prior art knives are either Z- or U-shaped when viewed from the side, one leg of the U or the Z in each case constituting the cutting face or cutting edge, while the knife if fixed to the tool carrier or spindle by the other leg. The intermediate member or adaptor which connects the two legs and which extends substantially at a right-angle to them serves above all to permit the knife also to be used in inaccessible places such as, for example, in the case of motor car windscreens, between the supporting surface in the window frame and the windscreen itself.

These prior art constructions have a plurality of disadvantages in common. To achieve adequate stability, the prior art knives are produced in one piece and from the same material since the part of the knife which extends from the cutting edge to the tool carrier and which is referred to hereinafter briefly as the shank, has always been made to be narrow and thin so that the cutting edge of the knife can reliably reach the aforementioned inaccessible places.

However, since the knives consist of an especially alloyed material, which is tough, resilient and difficult to machine, manufacture of the connecting portion of the shank was also correspondingly expensive and involved, and generally substantially more material was used for producing the shank than for producing the cutting edge part of the knife. On the other hand, however, the aforementioned material properties which are important for the cutting edge, are of only secondary importance to the shank. It is only necessary to have a certain strength even though the overall dimensions are small, since the knife is subjected to substantial loadings when in use.

Furthermore, in the case of the prior art knives, the axis of rotation is quite remote from the shank part which extends at right-angles to the cutting face. Therefore, also this part performs the oscillatory rotary movements, executing a travel of a few millimetres. In the case of windscreens which are fitted tightly into the vehicle frame, when such a tool is being used, this shank part fits exactly between the edge of the windscreen and the vehicle frame. As a result of the oscillatory rotary movements of this shank part, therefore, it is possible for the vehicle frame and/or the windscreen to become damaged. From this point of view, it would be more sensible for this part of the shank to be disposed close to the axis of rotation or for the axis of rotation even to extend through this part of the shank.

OBJECTS OF INVENTION

Therefore, the invention is based on the problem of providing a knife having the features mentioned at the outset but for the manufacture of which less expensive material is used and in which the reciprocating movements of the shank are considerably reduced.

SUMMARY OF INVENTION

In accordance with this invention, an improved knife insert is provided for tools with an oscillating head, e.g. of the type used for cutting open the rubber or adhesive beading around automobile windscreens, wherein the knife is angled over at a right-angle to its cutting face, in an L-shape, and wherein the second leg of the L, which extends substantially at a right-angle to the cutting face, comprises the connecting element for connecting the knife to the actuating tool.

BRIEF DESCRIPTION OF DRAWINGS

FIG. 1 is a side view of a knife insert according to the invention with a connecting element;

FIG. 2*a* shows the knife in FIG. 1 but in a plan view from above;

FIGS. 2*b–e* each show views corresponding to FIG. 2*a*, but of various types of knife inserts;

FIG. 5 is a view corresponding to FIG. 4, with a locking pin inserted of an actuating tool (not shown) into the spindle;

DETAILED DESCRIPTION

Figure 3:
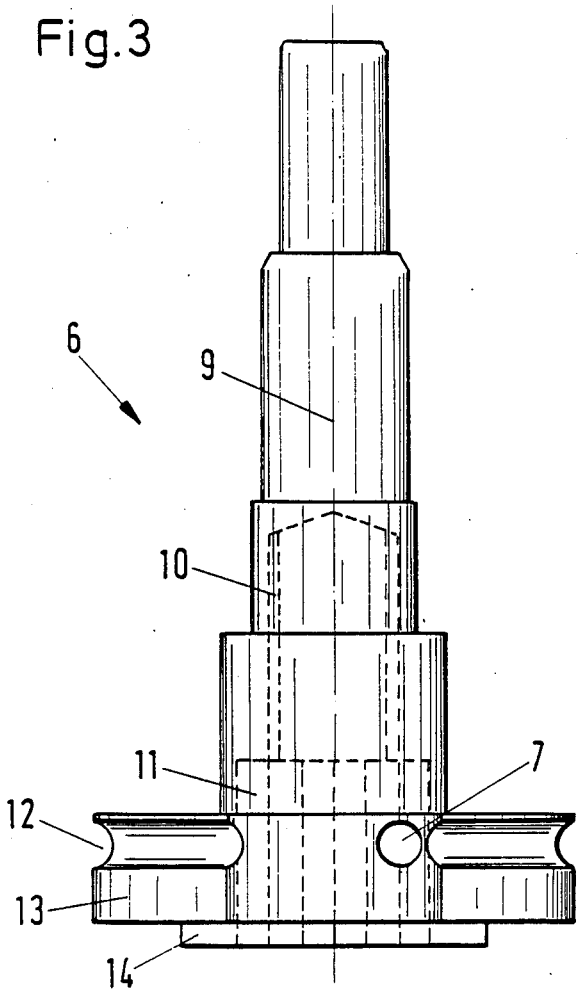
FIG. 3 is a side view of a spindle into which knife inserts can be fitted.

As indicated in the Summary of Invention, the knife insert according to this invention is characterised by an L-shape configuration having a cutting edge and a connecting element at right angles thereto.

The last-mentioned connecting element, which extends virtually in the direction of the second leg of the L can thereby be produced from some other more inexpensive material, than that used for the knife itself. Only the cutting edge itself and the angled over second leg of the L are still produced from a material which is tough and difficult to machine.

Since the connecting element is mounted directly on the second leg of the L and since the connecting element is usually mounted concentrically of the axis of rotation of the spindle-like tool carrier, also the second leg of the L is itself disposed in the immediate vicinity of the axis of rotation and correspondingly performs only very minor reciprocating movements when in operation.

According to the invention, it is envisaged, that the connecting element be welded to the second leg of the L. This can preferably be done by friction welding.

Such a joint is very durable and can be made in a matter of seconds. In particular it is possible to choose for the connecting element a material which can be worked substantially more easily than the material of which the knife cutting edge and the shank consists and which can nevertheless be welded to the knife shank.

The invention envisages thereby that the connecting element be a part which a polygonal cross-section. Such a part can easily be mounted in force and form-locking manner in a corresponding housing on the tool carrier on the spindle of the appliance which drives the knife.

In this respect, it is preferable for the connecting element to have a square or hexagonal cross-section. Square and hexagonal shapes are in common use for the transmission of forces, so that correspondingly prepared raw material can be purchased and machined at favourable cost. So that the welded joint between the connecting element and the shank or the second leg of the L of the knife can be produced with the greatest possible strength, it is advantageous if the connecting element and the shank are in contact with each other over a large area. In the case of a square-section material, this is easily achieved. With hexagonal or polygonal-section stock, it is possible for one of the faces of the connecting element to be made larger in the area in which connection is made with the shank, so that the result is no longer the conventional and regular cross-sectional form. Instead, the connecting element will be of asymmetrical shape, at least in the area in which it is welded to the shank of the knife.

In addition to the aforementioned square or hexagonal-section shapes, particularly the octagonal or dodecahedral form or an undulating form on the surface of the connecting element are expedient.

In this case of polygonal elements, these need not be regular polygonal shapes. For instance, particularly a quadrangular section may also have two narrow and two broad sides, in other words it may have the cross-section of a strip of sheet metal. If necessary, also the second leg of the L of the knife insert may itself constitute the connecting element 4. With a suitably chosen width of such a quadrangular connecting element in the form of a strip or a plate, then this can also be inserted into housings for a spindle which are otherwise intended for regular polygonal shapes, the two narrow sides of the connecting element bearing in each case on oppositely disposed corners of the polygonal housing.

Instead of the aforementioned shapes, in which the connecting element is force-lockingly and form-lockingly introduced easily into a corresponding shaped housing aperture in the tool carrier or spindle, it is possible with another example of embodiment of the invention also to provide a screwed joint between the connecting element and the tool carrier. In particular, the connecting element itself may be constructed as a screw which can be screwed into a corresponding threaded portion in the tool carrier or in the spindle.

The symmetrical polygonal push-in connections have the advantage that the knife insert can in each case be rotated through fixed angular amounts and inserted into the spindle. In the case of a regular dodecahedral connection, for example, this angle is 30°. In the case of a screwed connection, the orientation of the knife is generally not so well defined but can be adjusted at will be additional retaining elements such as lock nuts or the like.

In a preferred embodiment of the invention, it is envisaged that the connecting element comprise a bore or a groove extending substantially at a right-angle to the direction of insertion of the connecting element into the tool carrier. A groove can, for example, be disposed at a fixed axial height along the total periphery of the connecting element so that an axial gripping of the connecting element by parts engaging into the groove is independent of the orientation in which the knife insert or the connecting element is inserted into the spindle.

According to the invention, it is thereby envisaged that a locking pin which has to be inserted through a fitting bore in the tool carrier can be introduced into the groove or bore.

Therefore, once the connecting element has been fitted or possibly even screwed into a corresponding housing in the spindle, the knife insert is secured against axial displacement in that a locking pin is introduced through a bore in the tool carrier which is located at the same axial height of the groove in the inserted connecting element. In this case, the bore in the tool carrier and the groove or a corresponding bore in the connecting element are so disposed in relation to each other that the locking pin also engages the groove or the bore in the connecting element. The locking pin can thereby in turn be secured against slipping out of the bore by the provision of spring elements. Axial locking of the knife is also necessary above all because the drive elements for the knife perform up to 25,000 strokes per minute and because a knife which slips out might well be thrown off at a high speed and could cause physical injury.

It has been found expedient if, in the case of the present invention, the connecting element is mounted on the second leg of the L, at a distance from the cutting face.

The connecting element which, for instance as a square or hexagonal-section member, has a markedly greater cross-section than the knife shank or the second leg of the L, cannot be readily inserted into narrow gaps or slots, e.g. between windscreens and bodywork, so that it is advantageous if the connecting element is mounted on the shank at a distance from the cutting face so that the remaining free part of the shank allows the knife to be inserted into the said inaccessible areas.

An embodiment is preferred in which the connecting element tapers in the direction of the cutting face. The connecting element can thereby be, as previously, also mounted at a distance from the cutting face and on the shank, or not. The tapering part then permits of better insertion of the knife and of the knife shank and possibly also parts of the connecting elements into the aforesaid inaccessible areas.

Furthermore, according to the invention, preference is given to a connecting element which can be inserted in form-locking manner into an adaptor which is provided with a screwed connection.

It is also possible for the push-in knife inserts to be mounted on a conventional spindle.

The new push-in knife inserts do not therefore require the exchange of entire driving units, but instead the conventional driving units can continue to be used, either the spindle alone being exchanged or the aforementioned adaptor being screwed onto the conventional spindle by means of a clamping screw.

Referring now to the drawing in more detail, FIG. 1 shows a knife insert 1 with a cutting face 2 and a shank 3 on which is welded a connecting element 4. The connecting element 4 is mounted on the shank 3 at a distance from the cutting face 2 and is chamfered at its bottom left-hand corner so that it tapers in the direction of the cutting face 2. In this way, additional space is gained so that working with the knife becomes possible in corner areas and similar places which are difficult of access.

The connecting element 4 has in its upper third an encircling semi-cylindrical groove 5 and has for the rest the shape of a square rod as can best be seen in FIG. 2*a*.

FIG. 2*a* furthermore shows that the connecting element 4 is not disposed exactly above the cutting face 2 but is slightly offset. The axis of rotation about which the knife performs rotary oscillations when in use coincides substantially with the axis of symmetry 8 of the square rod. By a suitable choice of the dimensions of the chamfering of the bottom left-hand corner, and the dimensions of the cutting face 2 and the knife shank 3, it is possible for the knife as a whole to be balanced in relation to the axis of rotation 8, the latter therefore extending through the centre of gravity of the knife insert 1. This contributes to particularly smooth running during operation of the cutting instrument.

It can be seen from FIG. 2*a* that the cutting face 2 has on both sides longitudinally curved cutting edges 19.

The embodiment shown in FIG. 2*b* differs from that in FIG. 2*a* only in that the connecting element 4 is disposed above the rear end of the cutting face 2 and is not laterally offset. FIGS. 2*c, d* and *e* show further types of knife, FIG. 2*e* illustrating the cross-section of the connecting element 4 which appears in the form of a regular hexagon. As indicated by a broken line, the bottom area of the connecting element has one corner of the hexagon completely milled or ground off so that in the region of connection to the shank 3, the hexagon can be welded over a relatively large area.

The knives shown can have cutting edges either on only one side or also on both sides.

FIG. 3 shows a spindle 6 of an actuating tool (not shown) which, when in operation, performs oscillating rotary movements about an axis of rotation 9. The maximum angle of rotation during these movements is generally less than 20°.

The spindle 6 consists of a multi-stepped cylindrical construction, the lower parts of the cylinder being constructed with a widened diameter to receive a knife insert. For the prior art knives, it was conventional to provide for fixing by means of a screw in the threaded portion 10, the screw not being however rigidly connected to the knife insert, the knife being fixed in only one specific position.

The spindle 6 described here still leaves open such a possibility of fitment, since in addition to the cross-sectionally stellate housing 11, the screwthread 10 is provided in the interior of the spindle 6. In this case, the fixing part of a conventional knife comes to bear either on the under surface of the disc 13 or hexagonal plate 14. For the rest, the hexagonal plate 14 is a means whereby the spindle 6 can be securely gripped by a spanner or the like when fitting a knife insert or during other work on the spindle 6.

Figure 4:
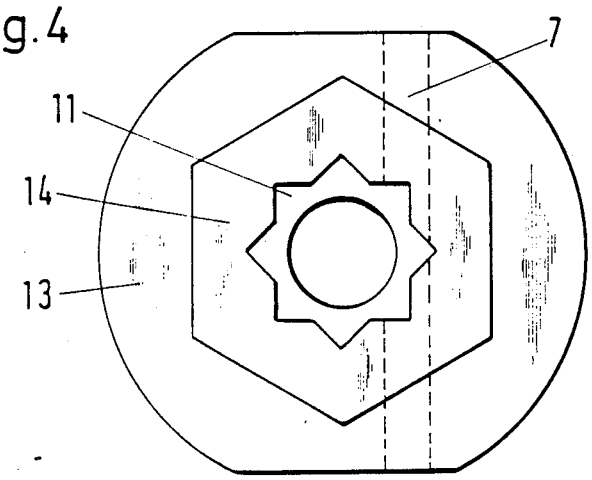
FIG. 4 is a view of the spindle according to FIG. 3, seen from below.

The housing 11 for the push-in knife insert 1 is of stellate construction, having eight right-angled outer corners, as can best be seen from the view from below, reproduced in FIG. 4. In this way, it is possible also to insert into the housing 11 a four-sided connecting element 4, such as is shown in FIGS. 1 and 2*a* to 2*d*. The corners of the square section fit into every second corner of the eight-cornered star 11. By reason of the eight-cornered cross-section of the housing 11, it is possible to insert the knife insert 1 into the housing 11 rotated in each case by a fixed angle of 45° or a multiple thereof. The disposition of the knife insert 1 can therefore be adapted with optimum effect to the particular space and working conditions available. Movement of the knife itself is unaffected by the orientation of the connecting element 4 in the housing 11, since the axis of symmetry 8 of the connecting element 4 coincides with the axis of rotation 9 of the spindle 6.

The plate 13 at the bottom end of the spindle 6 also comprises a bore 7 through which it is possible to fit a locking pin 15. The distance between the bore 7 and the upper end face of the housing 11, on which the connecting element 4 of the knife insert 1 abuts during insertion, coincides thereby essentially with the distance between the groove in the connecting element 4 and the top edge or upper surface thereof, which strikes the end face of the housing 11. After the connecting element 4 has been pushed into the housing 11, if the locking pin 15 is introduced into the bore 7, then the locking pin lies in the groove 5 in the connecting element 4 and so prevents any axial displacement or slipping of the connecting element 4 out of the housing 11. The locking pin shown in FIG. 5 is, in the embodiment shown, obtainable as an annular spring pin in standard sizes. The second leg 16 of the locking pin 15 engages thereby a groove 12 disposed on the outer rim of the plate 13, the curvature of the second leg 16 being in addition adapted to the curvature of the plate 13. By virtue of the fact that the locking pin is constructed as an annular spring element, the leg 16 of the locking pin 15 presses against the outer edge of the groove 12, while the leg 17 of the locking pin 15 is housed in the bore 7 in the plate 13 and in the groove 5 of the connecting element 4. In this way, the locking pin 15 cannot slip out of the bore 7 and the groove 5, so that the connecting element 4 or the knife insert 1 are reliably held. The bore 7 can be disposed at will in the plate 13 so long as only that part of it which is radially on the inside in relation to the plate 13 is aligned with the groove 5 in an inserted connected element 4.

It is also possible to provide a pluarality of such and possibly also intersecting bores 7 in the plate 13.

The spindle 6 shown can therefore be used optionally for fixing the prior art and, when viewed from the side, U-shaped knives or knife inserts, or for the new push-in knife inserts 1 according to the present invention.

A great advantage of the push-in knife inserts in conjunction with the corresponding spindle resides in the fact that the knife inserts can be very quickly released from the housing 11 by withdrawing the locking pin 15 and taking out the connecting element 4 from the housing 11, whereupon the insert can perhaps be changed. Particularly in the case of constantly changing jobs, for example when cutting out windscreens from different types of vehicle in a repair shop, the possibility of quickly changing knives can be a great advantage.

In addition, by reason of the proximity of the second leg 3 of the L to the axis of rotation 9, unintended abutment of this leg of the knife is restricted locations between bodywork and windscreen can be avoided.

Of course, in addition to the described embodiment, other embodiments of knife insert and of associated spindle, such as have in some cases already been mentioned, are also conceivable. For example, it is possible to dispense with the screwthread 10 and the housing 11 may have a hexagonal or dodecahedral cross-section while the connecting element 4 can also be otherwise secured against axial displacement, such as for example by a locking ring, a snap-action coupling or the like.

In the case of the embodiment shown in FIG. 2*d*, in contrast to the other embodiments, the connecting element 4 is disposed on the outside, i.e. on that side of the second leg 3 of the L which is remote from the cutting face. The connecting element 4 could also be slotted in its lower part, the leg 3 of the L being housed in a slot 3 in which it is welded. In the case of such an embodiment or also in the case of the embodiment shown in FIG. 2*e*, in which the connecting element 4 is milled off on one side at the bottom, the axis rotation 9 can extend through the leg 3 of the L so that in consequence the oscillatory rotary movements of the leg 3 of the L have a minimal amount of reciprocation.

Figure 6:
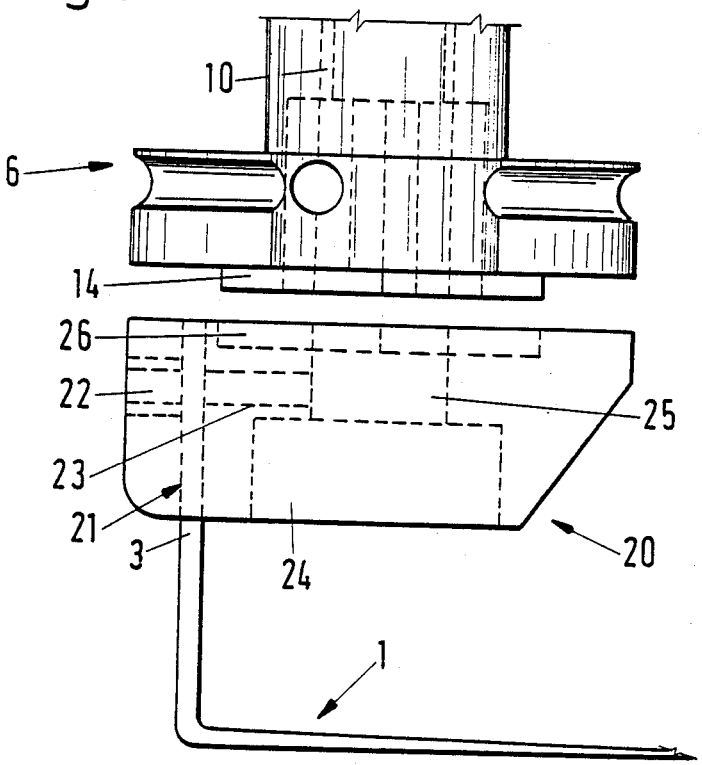
FIG. 6 is an adaptor for mounting an L-shaped knife on a spindle.
Figure 7:
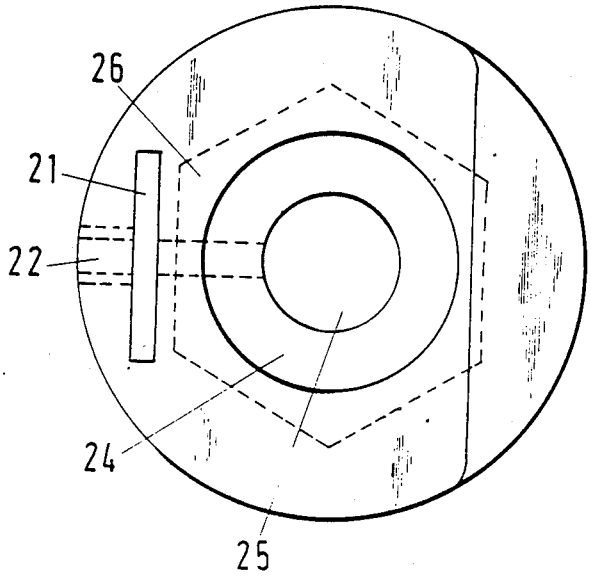
FIG. 7 is a view of the adaptor in FIG. 6 from below.

FIG. 6 is a side view of an adapter 20. The adaptor 20 comprises a slot 21 to accommodate a leg 3 of an L-shaped knife insert 1. The leg 3 of the knife insert 1 can be fixed in the slot 21 of the adaptor 20 by means of a screw in that the screw is screwed into the threaded portion 23 of the bore 22, clamping the leg 3 securely in the process. The leg 3 can for this purpose comprise a matching bore through which such a screw is introduced. The leg 3 of the knife insert 1 could also be gripped in the slot 21 by other clamping elements, in particular the slot could also be constructed between a movable part of the adaptor 20 and the other part of the adaptor.

The adaptor 20 is fixed on the spindle 6 by means of a screw, the screw being screwed into the screwthread 10 of the spindle 6. The adaptor 20 has thereby a screwhead housing 24 and also a through bore 25.

Furthermore, the adaptor 20 has a recess 26 to house the hexagonal plate 14, so that it can be non-rotatably connected to the spindle 6.

The adaptor 20 can be mounted both on the conventional spindles and also on the spindles 6 which according to the invention comprises a housing for push-in knife inserts.

In order to have as much free space as possible above the cutting face of the knife insert 1, the adaptor 20 is chamfered off on the side opposite the slot 21.

The knife inserts hereinbefore described are intended merely to be illustrative of preferred embodiments of the invention and are in now way limiting. Thus various modifications and variations may be made therein without departing from the spirit and scope of the invention as herein described and as hereinafter defined in the appended claims.

I claim;

1. In a knife insert for tools with an oscillating head, such as the type used for cutting open rubber or adhesive beading strips around windscreens, and having a cutting face bounded by one or a plurality of cutting edges, the improvement being that a section of the knife is in the form of an L-shape at right-angles to its cutting face, the cutting face forming a first leg of the L and the second leg of the L, which extends substantially at a right-angle from the cutting face, being attached to a connecting element for connecting the knife to an actuating tool so that rotational oscillating motion is imparted to the cutting face and wherein the connecting element contains a bore or groove in its surface, the groove or bore extending substantially at a right-angle to the direction of connection of the knife insert on to the actuating tool.

2. A knife insert according to claim 1, wherein the connecting element is welded to the second leg of the L.

3. A knife insert according to claim 1, wherein the connecting element is polygonal in cross-section.

4. A knife insert according to claim 3, wherein the connecting element has a square or hexagonal cross-section.

5. A knife insert according to claim 1, wherein the connecting element is threadedly attached to the actuating tool.

6. A knife insert according to claim 1, wherein the connecting element is connected to the actuating tool by means of a locking pin extending through a bore in the actuating tool and received within the groove or bore in the connecting element.

7. A knife insert according to claim 1, wherein the connecting element is mounted alongside the second leg of the L at a distance remote from the cutting face of the knife.

8. A knife insert according to claim 1, wherein the connecting element tapers in the direction of the cutting face of the knife.

9. A knife insert according to claim 1, wherein the connecting element can be inserted in form-locking fashion into an adaptor which can be screwed onto a spindle on said actuating tool.

10. A cutting tool employing an angle of substantially ninety degrees that is used to cut open rubber or adhesive beading strips around windshields of automobiles and the like which is connected to an actuating tool that provides rapid oscillatory rotational movement comprising an L-shaped instrument which has, at a first leg of the L, a plurality of cutting edges, and, at a second leg of the L, a shank, and a connecting element containing a bore or groove in its surface, the groove or bore extending substantially at a right-angle to the direction of connection of the shank onto the actuation tool so that at least one of the cutting edges may be connected to circumscribe an angle of approximately forty-five degrees in a plane substantially perpendicular to the partially rotating shank.

* * * * *

UNITED STATES PATENT AND TRADEMARK OFFICE

CERTIFICATE OF CORRECTION

PATENT NO. : 4,852,261

DATED : August 1, 1989

INVENTOR(S) : Winfried D. Wittek

It is certified that error appears in the above-identified patent and that said Letters Patent is hereby corrected as shown below:

Column 1, Line 23, after the words "one leg of the U or" insert "of".

Column 1, Line 25, after the words "the knife" delete "if" and insert "is".

Column 3, Line 5, before the words "on the spindle" insert the word "or".

Column 3, Line 44, add the letters "ly" to the word "corresponding"

Column 3, Line 58, after the words "adjusted at will" delete the word "be" and insert "by".

Column 4, Line 42, after the word "also" insert "of".

Column 6, Line 53, after the words "leg of the knife is" insert the word "in".

Column 7, Line 38, after the words "invention and are in" delete the word "now" and insert "no".

UNITED STATES PATENT AND TRADEMARK OFFICE

CERTIFICATE OF CORRECTION

PATENT NO. : 4,852,261

DATED : August 1, 1989

INVENTOR(S) : Winfried D. Wittek

It is certified that error appears in the above-identified patent and that said Letters Patent is hereby corrected as shown below:

Column 8, Line 42 , after the words "cutting edges, and, at" delete the word "a" and insert "the".

Column 8 Line 46, after the words "shank onto the" delete the word "actuation" and insert "actuating".

Signed and Sealed this

Third Day of July, 1990

*Attest:*

*Attesting Officer*

HARRY F. MANBECK, JR.

*Commissioner of Patents and Trademarks*